US005547289A

United States Patent [19]

Urban

[11] Patent Number: 5,547,289

[45] Date of Patent: Aug. 20, 1996

[54] BEARING SYSTEM

[75] Inventor: Jörg Urban, Ludwigshafen, Germany

[73] Assignee: KSB Aktiengesellschaft, Frankenthal, Germany

[21] Appl. No.: 403,685

[22] PCT Filed: Sep. 10, 1993

[86] PCT No.: PCT/EP92/02451

§ 371 Date: Mar. 14, 1995

§ 102(e) Date: Mar. 14, 1995

[87] PCT Pub. No.: WO94/07034

PCT Pub. Date: Mar. 31, 1994

[30] Foreign Application Priority Data

Sep. 14, 1992 [DE] Germany ..... 42 30 714.7
Aug. 14, 1993 [DE] Germany ..... 43 27 425.0

[51] Int. Cl.[6] ..... F16C 23/04

[52] U.S. Cl. ..... 384/215; 384/192

[58] Field of Search ..... 384/192, 205, 384/215, 295, 296, 276

[56] References Cited

U.S. PATENT DOCUMENTS

| | | | |
|---|---|---|---|
| 2,517,477 | 8/1950 | Griffin . | |
| 2,892,663 | 6/1959 | Nickerson | 384/192 |
| 2,956,841 | 10/1960 | Cametti et al. | 384/215 |
| 3,388,880 | 6/1968 | Knight, Jr. | 384/215 |
| 3,659,910 | 5/1972 | Foster | 384/119 |
| 4,505,637 | 3/1985 | Raczynski . | |
| 5,106,262 | 4/1992 | Oklejas et al. | 415/111 X |

FOREIGN PATENT DOCUMENTS

| | | |
|---|---|---|
| 752783 | 9/1933 | France . |
| 2254265 | 4/1974 | Germany . |
| 2847909 | 11/1978 | Germany . |
| 2901638 | 8/1979 | Germany . |
| 3011380C2 | 3/1980 | Germany . |
| 3419038 | 1/1985 | Germany . |
| 3834862A1 | 10/1988 | Germany . |
| 4108257A1 | 3/1991 | Germany . |
| 1323754A1 | 11/1985 | U.S.S.R. . |
| 1373888A2 | 6/1986 | U.S.S.R. . |
| 1448113A1 | 3/1987 | U.S.S.R. . |
| 1707262A1 | 2/1990 | U.S.S.R. . |
| 805825 | 10/1956 | United Kingdom . |
| 909550 | 12/1960 | United Kingdom . |

*Primary Examiner*—Thomas R. Hannon
*Attorney, Agent, or Firm*—Darby & Darby, P.C.

[57] ABSTRACT

A bearing arrangement at the intake aperture of a centrifugal pump impeller in which a bearing shell (5) arranged in the housing (4) can be fitted from outside the pump. The bearing shell (5) is positioned by a retainer (7) and the flange (10) of a pipe to be connected thereto.

8 Claims, 2 Drawing Sheets

BEARING SYSTEM

BACKGROUND OF THE INVENTION

1. Field of the Invention

This invention relates to a bearing system for centrifugal or rotary pumps, consisting of a bearing seat or shell situated within the pump housing and of a centrifugal-pump impeller pivoting within the bearing shell on the intake port.

2. Discussion of the Related Art

A bearing system is described in GB-PS 805 825. There, the bearing shell of a hydrostatic bearing is pressed into the pump housing, and an impeller having an elongated suction or intake port extends into, and pivots in, the shell. This is a complex and costly design in that it requires very precise machining of the inside of the housing in order to prevent misalignment in the assembly stage. A somewhat similar design is shown in DE-OS 30 11 380 in which a double-suction impeller, with both of its intake ports, is supported directly within corresponding bearing shells.

The intake port may be designed to also serve as the rotor of an electric motor as has been described in GB-PS 909 550.

SUMMARY OF THE INVENTION

This invention is aimed at providing for centrifugal pumps in this general design category a bearing system that is easy to install and can be controlled with a minimum of effort and cost. The solution to the problem includes a bearing shell disposed within the pump housing of a centrifugal pump. A retaining unit, which may be manipulated from the outside, holds the bearing shell in position within the housing. The present invention permits the machining of the surfaces accepting the bearing-shell, and also permits the installation of the bearing shell itself, from the outside of the pump housing. Apart from easier accessibility, this translates into a substantially reduced machining process. It also permits easy checking of the condition of the bearing by simply disconnecting the attached pipe such as a suction pipe. In the past this inevitably involved a disassembly of the pump which has now become altogether unnecessary. The subclaims describe Additional enhancements and advantageous design features of this invention include, for example, that the contact surfaces between the retaining unit and the flange and housing, respectively, can be sealed by means of well-established methods using for instance O-rings, flat gaskets or the like. The type of seals and gaskets to be selected is determined by the nature of the operating conditions of the pump. Anti-twist locking elements prevent any possible rotation of the bearing shell. To compensate for dimensional tolerances in manufacturing and for shaft deflection and to attentuate vibration of the rotating unit, the bearing shell is mounted in tiltable fashion. By way of example, this can be accomplished by means of a narrow, outward rim or collar by which the bearing shell is kept centered in the housing. The bearing shell or the collar may be provided with two lugs or stubs which, while permitting a tilting movement, assure support of the bearing shell on the retaining unit. This configuration is useful in the case of pumps with high internal pressure levels which might attain magnitudes in excess of the level that car, be handled by an elastic tilt mount.

If there is wear and tear on the bearing shell, the design of the bearing system is such as to permit easy replacement. The shortest physical length of a pump is attained when the flange of a pipe conduit connected to the pump bears directly on a retaining unit. In this extremely simple fashion, the flange bolts, via the retaining unit, serve to fasten the pump bearing inside the housing. This approach is equally suitable for single-stage and multi-stage centrifugal pumps. A bearing system based on this design permits both a reduction of the overall physical length of the pump and a substantial improvement in the rigidity of the rotating assembly.

BRIEF DESCRIPTION OF THE DRAWINGS

A design example of this invention is illustrated in the diagrams and explained in more detail in the following description.

DETAILED DESCRIPTION OF A PREFERRED EMBODIMENT

Figure 1:
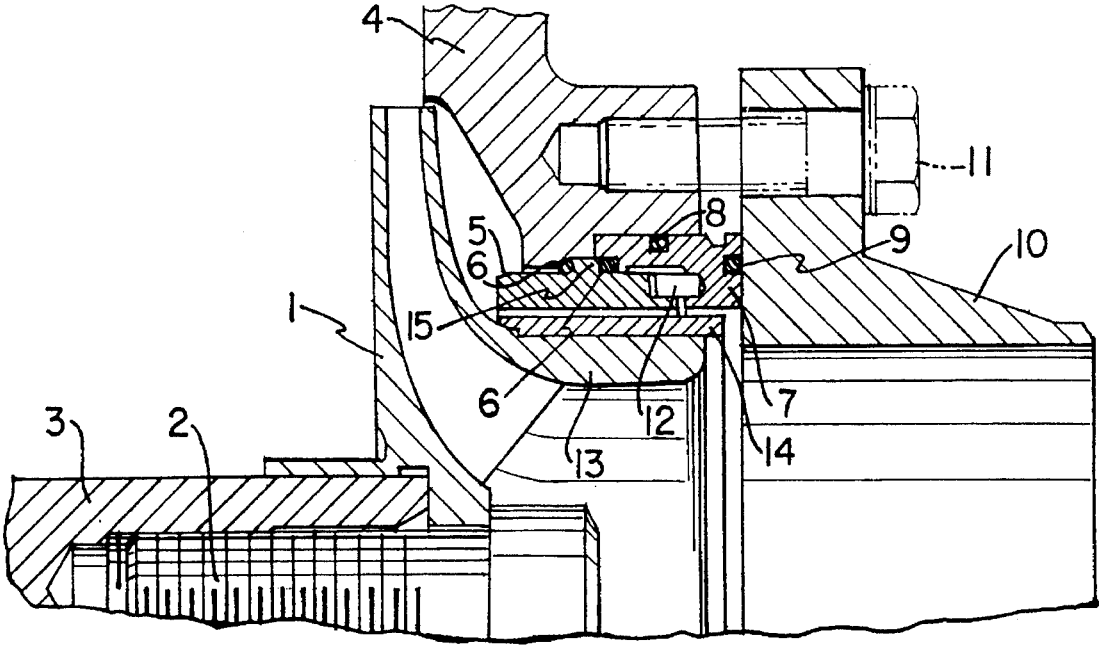
FIG. 1 shows a cross section of the first impeller of a pump.

FIG. 1 shows an impeller 1 of a single-stage centrifugal pump, or the first impeller of a multi-stage centrifugal pump, fastened to a shaft 3 by means of a screw 2. A bearing shell 5 is inserted from the outside into the housing 4 and is supported in tiltable fashion with its narrow collar 15 positioned between elastic gasket rings 6. A retaining unit 7, likewise installable from the outside, holds the bearing shell 5 in place. In terms of functionality, the retaining unit 7 is in this case designed as a thrust collar. A gasket 8 seals the retaining unit 7 off against the housing 4 while a gasket 9 seals it against the flange 10 of a pipe conduit that feeds the medium to the pump. Conventional fastening means, bolts 11 in this example, tightly hold the flange 10 against the housing 4 and, in the process, press the retaining unit 7 and the abutting bearing shell 5 into the housing 4. An anti-twist lock 12 prevents any rotation of the bearing shell 5. At the intake port 13, the impeller is provided with a race 14 which slides inside the bearing shell 5.

Figure 2:
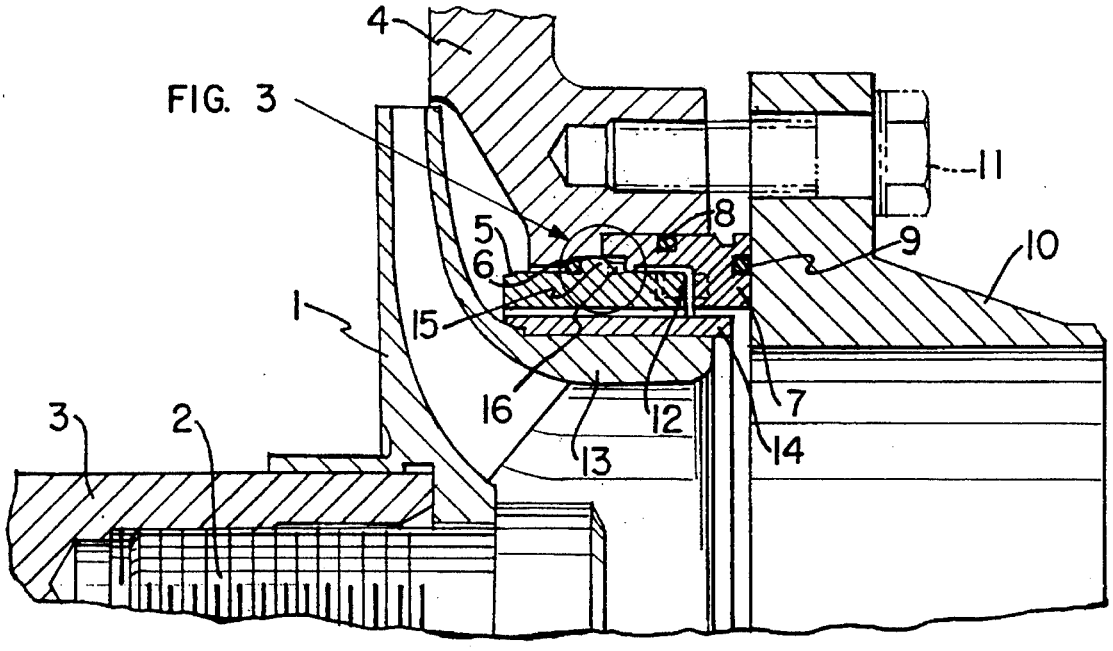
FIG. 2 shows a section along the horizontal plane of a pump operating at a higher pressure level.

For applications involving very high pressure levels in the lateral space around the impeller 1, FIG. 2 shows a solution whereby two axially protruding stubs 16 are provided in the horizontal plane of the rings on the collar 15. The sectional view shown here corresponds to a horizontal cross section through the intake side of a pump. The force of the pressure on the intake side of the lateral space around the impeller causes the bearing shell 5 to be pushed forward against the direction of the medium feed flow and to be braced by the retaining unit 7. The two lugs or stubs 16 protruding horizontally ensure the possibility of a tilting movement in the event of a shaft deflection. In lieu of the two elastic gasket rings 6 only one single gasket ring 6 is used in this design.

Figure 3:
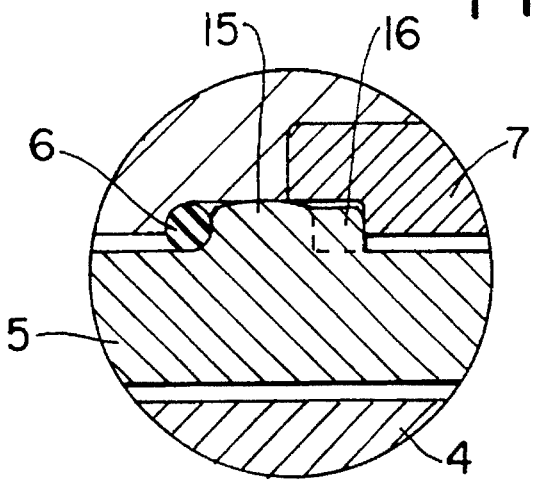
FIG. 3 is an enlarged representation of a detail in FIG. 2.

FIG. 3 is an enlarged representation of the detail within the circle in FIG. 2. In the example shown here, the collar 15 is provided with two stubs 16 extending in the horizontal plane at diametrically opposite ends. These stubs are in direct contact with the retaining unit 7 and transfer to it those axial pressures which, as a function of the pressure level in the lateral space around the impeller on the intake side, bear on the exposed front face of the bearing shell 5. The contact area of the stubs 16 is so designed and dimensioned that the maximum permissible surface pressure is not exceeded while at the same time the tilting motion around the two stubs 16 is assured.

Figure 4:
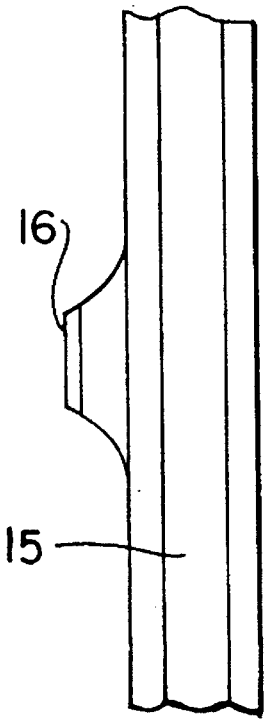
FIGS. 4 and 5 are, respectively, an enlarged representation of a side view and a top view of a stub.
Figure 5:
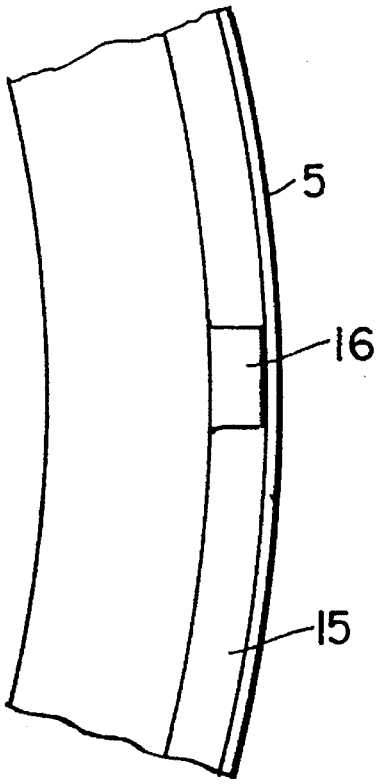

FIG. 4 shows an enlarged side view of one stub 16 on the collar 15 while FIG. 5 is a frontal view of a bearing shell 5 incorporating such protruding stubs 16. These stubs may be produced for instance by a machining, pressure-bonding, casting or any other conventional mechanical process.

This type of impeller or shaft bearing arrangement permits easiest possible access to the bearing for inspection and verification purposes. By simply removing the pipe conduit, here shown in the form of a suction pipe, one can instantly inspect the bearing and, if damaged, replace it in short order. Complete disassembly of the pump, a common practice in the past, is no longer necessary. The operator of a centrifugal pump designed according to this invention is thus able not only to inspect and, if necessary, repair the unit without any difficulty but also benefits from a mere minimum of production downtime. Moreover, this concept lends itself to a substantial reduction in the physical length of the pump. This is important considering that the widely used design in which the shaft bearing pivots in a bearing support located within the inlet cross section can quite negatively affect both the vibrational properties and the physical length requirements.

I claim:

1. A bearing arrangement for a centrifugal pump comprising:

a pump housing;

an impeller rotatably mounted within said pump housing, said impeller including an intake port;

a beating shell pivotably mounted within the pump housing about the intake port, wherein a retaining unit, which may be manipulated from outside the pump housing holds the beating shell in position within the pump housing.

2. A bearing arrangement as in claim 1, wherein the retaining unit is sealed against the pump housing and a flange.

3. A bearing arrangement as in claim 1 wherein the pump housing or the retaining unit is provided with at least one anti-twist locking element connected to the beating shell to prevent rotation of the beating shell.

4. A bearing arrangement as in claim 1, wherein the beating shell is so mounted as to permit a removal thereof for replacement.

5. A beating arrangement as in claim 4, wherein, by means of a radially protruding collar positioned between elastic tings, the bearing shell is mounted in a manner permitting the pivoting motion.

6. A beating arrangement as in claim 4, wherein the beating shell protrudes in the axial direction with at least two coplanar stubs.

7. A bearing arrangement as in claim 6, wherein the stubs butt against the retaining unit.

8. A bearing arrangement as in claim 1, wherein a flange of a feeder pipe connected to the pump presses the retaining unit against the bearing shell.

* * * * *

UNITED STATES PATENT AND TRADEMARK OFFICE

CERTIFICATE OF CORRECTION

PATENT NO. : 5,547,289

DATED : August 20, 1996

INVENTOR(S) : Jörg URBAN

It is certified that error appears in the above-indentified patent and that said Letters Patent is hereby corrected as shown below:

Title page, [86], PCT No., change "PCT/EP92/02451" to --PCT/EP93/02451--.

Signed and Sealed this

Fifteenth Day of April, 1997

Bruce Lehman

*Attest:*

BRUCE LEHMAN

*Attesting Officer*

*Commissioner of Patents and Trademarks*